United States Patent [19]

Takeda et al.

[11] 4,341,191

[45] Jul. 27, 1982

[54] FUEL INJECTION TYPE CARBURETOR

[75] Inventors: Keiso Takeda; Shozo Inouye; Toshimi Kashiwakura, all of Susono, Japan

[73] Assignee: Toyota Jidosha Kogyo Kabushiki Kaisha, Toyota, Japan

[21] Appl. No.: 169,205

[22] Filed: Jul. 15, 1980

[30] Foreign Application Priority Data

Aug. 1, 1979 [JP] Japan ..... 54-97209

[51] Int. Cl.[3] ..... F02M 61/14

[52] U.S. Cl. ..... 123/445; 123/52 M; 261/DIG. 82

[58] Field of Search ..... 123/445, 470, 472, 52 M, 123/590; 261/DIG. 82

[56] References Cited

U.S. PATENT DOCUMENTS

| | | | |
|---|---|---|---|
| 1,994,011 | 3/1935 | Bicknell | 123/52 M |
| 2,066,923 | 1/1937 | Wolfard | 123/52 M |
| 4,216,753 | 8/1980 | Inoue et al. | 123/445 |

FOREIGN PATENT DOCUMENTS

| | | | |
|---|---|---|---|
| 950776 | 2/1964 | United Kingdom | 123/470 |

*Primary Examiner*—Charles J. Myhre
*Assistant Examiner*—Andrew M. Dolinar
*Attorney, Agent, or Firm*—Stevens, Davis, Miller & Mosher

[57] ABSTRACT

A fuel injection type carburetor of multi-cylinder internal combustion engines including: a throttle body having a throttle bore extending substantially vertically and being connected at the bottom portion thereof to a collecting portion of intake manifolds extending substantially horizontally; a throttle valve arranged in the throttle bore, and; a linear injection type fuel injection valve having a fuel injection nozzle arranged in the throttle bore in a downstream area of the throttle valve and inclined toward the downstream side. The throttle bore has an extension extending downwardly into the intake manifold collecting portion so that a fuel jet injected from the fuel injection nozzle strikes against the extension of the throttle bore.

1 Claim, 5 Drawing Figures

FUEL INJECTION TYPE CARBURETOR

BACKGROUND OF THE INVENTION

The present invention generally relates to a fuel injection type carburetor, and more particularly relates to a fuel injection type carburetor of multi-cylinder internal combustion engines.

In the field of multi-cylinder gasoline internal combustion engines, fuel injection type carburetor has already been proposed. The proposed carburetor comprises respective fuel injection valves arranged in respective intake manifolds adjacent to intake ports of respective cyclinders, so that each fuel injection valve injects a required amount of fuel into the intake port of the corresponding cylinder. With this type of fuel injection carburetor, the amount of fuel to be supplied into each cylinder is advantageously uniform. On the other hand, with this type of carburetor, atomization of fuel to be supplied into the cylinders is not fully attained and a large number of fuel injection valves are required.

In order to solve these problems, another type fuel injection carburetor has been proposed, wherein one fuel injection valve is provided in the collecting portion of intake manifolds, so that fuel injected from the fuel injection valve is distributed to respective cylinders. With this type of fuel injection carburetor, it is advantageous that the fuel injection valve is electronically controlled so that a certain amount of fuel required for one combustion in each combustion chamber is intermittently injected from the fuel injection valve and the injected fuel is, in turn, supplied into respective combustion chambers. As a result, the amount of fuel to be supplied into respective combustion cylinders is uniform.

With the latter of the above-mentioned two types of fuel injection carburetors, however, the position of the fuel injection valve, the direction in which fuel is injected and the shape of a throttle valve have a large influence on the atomization characteristics of the fuel and the uniformity of the amount of fuel to be supplied into the respective cylinders.

SUMMARY OF THE INVENTION

An object of the present invention is to provide a fuel injection type carburetor by which the above-mentioned problems are solved.

Another object of the present invention is to provide a fuel injection type carburetor by which the atomization characteristic of fuel is improved over that of the prior art fuel to be supplied is uniformly distributed to respective combustion cylinders.

According to the present invention, there is provided a fuel injection type carburetor of multi-cylinder internal combustion engines comprising: a throttle body having a throttle bore extending substantially vertically and being connected at the bottom portion thereof to a collecting portion of intake manifolds extending substantially horizontally; said throttle bore having an extension extending downwardly into said collecting portion; a throttle valve arranged in said throttle bore; a linear injection type fuel injection valve having a fuel injection nozzle arranged in said throttle bore in an area downstream from said throttle valve and inclined toward the downstream side, so that a fuel jet injected from said fuel injection nozzle strikes against said extension of said throttle bore.

The present invention may be more fully understood from the description set forth below of preferred embodiments of the invention, with reference to the accompanying drawings.

BRIEF DESCRIPTION OF THE DRAWINGS

Referring to FIGS. 1 and 2, a body 1 of a multi-cylinder internal combustion engine is provided with intake manifold 2 rigidly secured thereto. As will be clearly understood from FIG. 2, the intake manifolds 2 extend substantially horizontally and are terminated at a collecting portion 3. A manifold flange 4 is formed integrally with the intake manifold 2 and is provided substantially horizontally at the upper portion of the intake manifold collecting portion 3. A substantially cylindrical throttle body 5 is provided at the bottom portion thereof with a mounting flange 6 formed integrally with the throttle body 5. The throttle body is also provided therein with a cylindrical throttle bore 7 extending substantially vertically and having a substantially uniform cross-section. As clearly seen from FIG. 2, the flange portion 6 of the throttle body 5 is rigidly secured to the manifold collecting portion 3 by a gasket 8 so that the throttle bore 7 is communicated with the manifold collecting portion 3 and extends therefrom vertically upward.

At the lower end of the throttle body 5, a cylindrical thin wall extension 9 is formed integrally with the throttle body 5 so that the extension 9 extends downwardly into the space of the intake manifold collecting portion 3. A lower edge 10 of the extension 9 is formed as a knife edge tapered outwardly, as illustrated in FIG. 2, so that the lower edge 10 is distanced from the inner peripheral wall of the intake manifold collecting portion 3.

Figure 3:
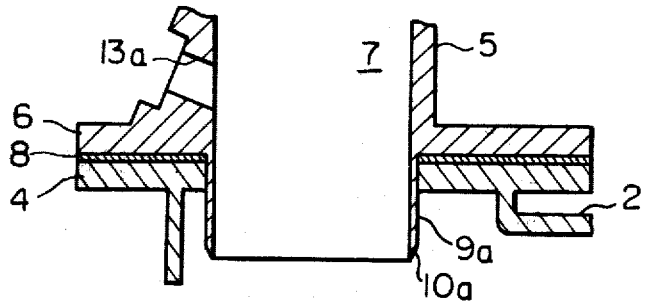
FIGS. 3 through 5 are cross-sectional views illustrating respective embodiments of the extension at the lower end of the throttle bore.
Figure 4:
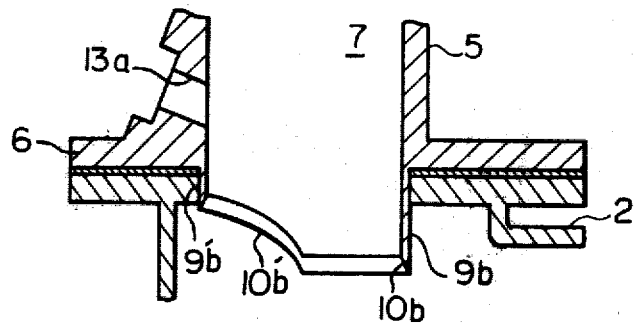
Figure 5:
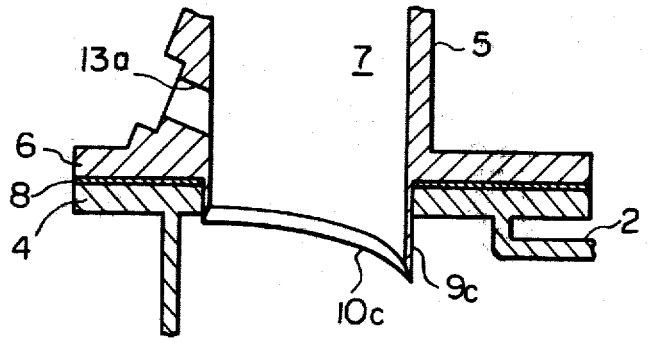

FIGS. 3 through 5 illustrate respective embodiments of the extension which extends downwardly into the space of the intake manifold collecting portion 3. In the embodiment illustrated in FIG. 3, the lower edge **10*a* of the cylindrical thin wall extension 9*a* is formed as a knife edge tapered inwardly. In the embodiment illustrated in FIG. 4, at a half cross-sectional area of the throttle bore 7 which is apart from a mounting position 13*a* of a fuel injection valve 13 mentioned below, the lower end of the throttle body 5 is provided with an extension 9*b* which extends downwardly into the space of the intake manifold collecting portion 3. A lower edge 10*b* of the extension 9*b* is formed as a knife edge tapered outwardly. At the opposite half cross-sectional area of the throttle bore 7 which is near the mounting position 13*a* of the fuel injection valve 13, the lower end of the throttle body 5 is provided with an extension 9'*b* which gradually extends downwardly from the side of the mounting position 13*a* of the fuel injection valve to the central portion of the throttle bore 7. A lower edge 10'*b* of this extension 9'*b* is also formed as a knife edge tapered outwardly and is connected to the lower edge 10*b* of the extension 9*b* in the vicinity of the above-mentioned central portion. In the embodiment illustrated in FIG. 5, the lower end of the throttle body 5 is provided with an extension 9c which gradually extends downwardly from the side of the throttle bore 7 which is near the mounting position 13a of the fuel injection valve to the opposite side of the throttle bore 7 which is apart from the mounting position 13a of the fuel injection valve. A lower edge 10c of this extension 9c is also formed as a knife edge tapered outwardly in the same manner as described above in the embodiment of FIG. 4**.

Figure 1:
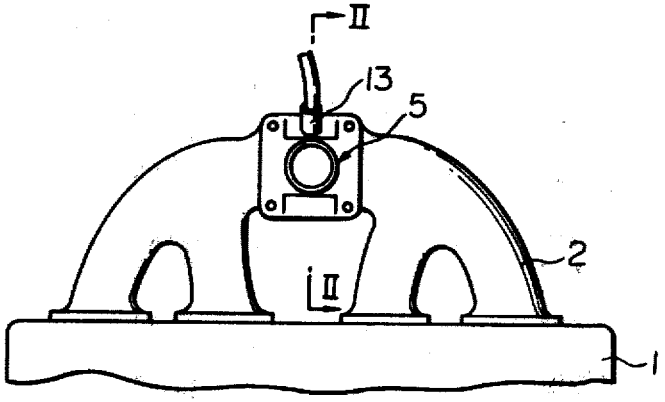
FIG. 1 is a plan view illustrating a part of a multi-cylinder internal combustion engine.
Figure 2:
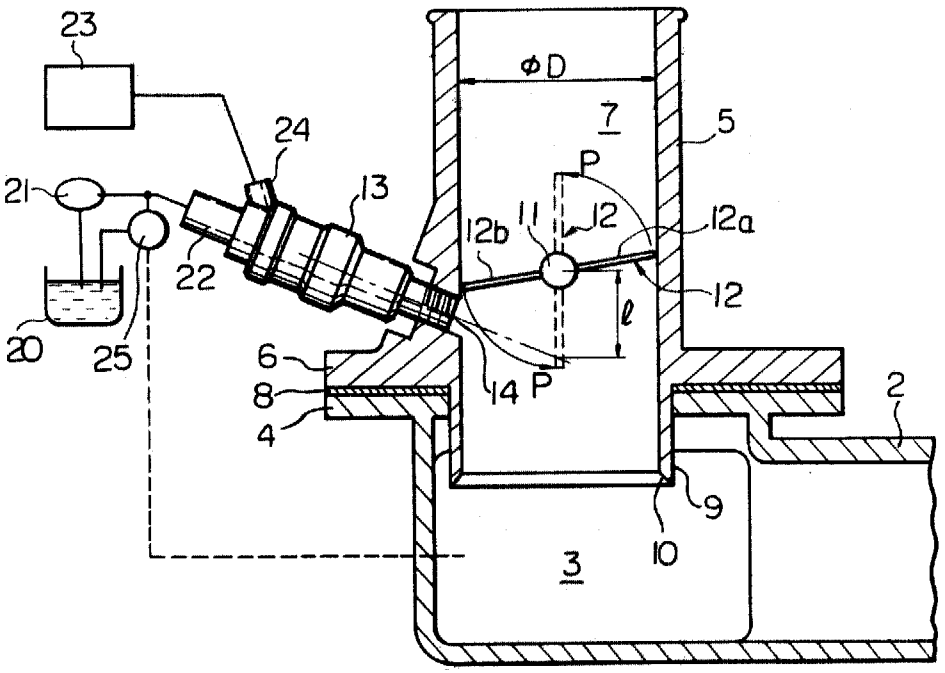
FIG. 2 is an enlarged cross-sectional view taken along line II—II in FIG. 1 and illustrating an embodiment of a fuel injection type carburetor of the present invention.

In FIG. 2, a throttle shaft 11 is rotatably mounted in the throttle bore 7 and a butterfly-type throttle valve 12 is rigidly secured to the throttle shaft 11. The throttle shaft 11 intersects the central axis of the throttle bore 7 and extends in a direction substantially perpendicular to the air flow direction in the intake manifolds 2. The throttle valve 12 has a valve half body 12a which extends in the direction of the engine body 1, that is, in the direction of the intake manifold 2, and is illustrated on the right side in FIG. 2, and; another valve half body 12b which extends in the opposite direction to 12a and is illustrated on the left side in FIG. 2. The throttle shaft 11 of the throttle valve 12 is connected to an accelerator pedal in a driver's compartment of the vehicle, not shown in the drawings, so that when the accelerator pedal is pressed, the throttle valve 12 turns in a counter-clockwise direction in FIG. 2 (to a position illustrated by a dotted line), so as to open the air passage of the throttle bore 7, and when the acceleration pedal is released, the throttle valve 12 turns in the clockwise direction in FIG. 2 (to a position illustrated by a solid line) so as to close the air passage of the throttle bore 7.

Downstream from the throttle valve 12 in the throttle bore 7 and at the opposite side of the bore 7 from that closest to the engine body 1 and the intake manifold 2, a linear injection type fuel injection valve 13 is mounted on the throttle body 5. As illustrated in FIG. 2, a fuel injection nozzle 14 of the fuel injection valve 13 is slightly inclined downwardly. Therefore, fuel is injected from the fuel injection nozzle 14 in the downwardly inclined direction in due order with respect to the air flowing in the intake manifold 2.

The relationship between the fuel injection valve 13 and the above-mentioned extension 9 is such that a fuel jet injected from the injection nozzle 14 of the fuel injection valve 13 strikes against an inner wall of the extension 9 at a position opposite to the nozzle 14.

As the fuel injection valve 13 is of the linear injection type, as mentioned above, a substantially linear fuel jet is injected from the fuel injection nozzle 14 of the fuel injection valve 13. This type of fuel injection valve is simpler in construction than a so-called swirl type fuel injection valve. Since such a linear type fuel injection valve is already known in the art, a detailed explanation concerning the construction thereof is omitted here.

Fuel to be supplied to the fuel injection valve 13 is fed to the valve 13 from a fuel tank 20 through a pipe line 22 by means of a fuel pump 21. The fuel injection valve 13 is electronically controlled by a control voltage transmitted from an electronic controller 23 through a connector 24 to the fuel injection valve 13. The fuel injection valve 13 thus injects intermittently a certain amount of fuel required for one combustion in respective cylinders and in synchronization with the time when intake valves of respective combustion cylinders are opened. Reference numeral 25 designates a pressure regulator which controls the amount of return fuel in response to the vacuum pressure of the intake manifolds 2.

In FIG. 2, the throttle valve 12 rotates from its closed position to its opened position in the counter-clockwise direction as shown by an arrow P in the drawing. During light-load or moderate-load driving conditions in which the opening degree of the throttle valve 12 is relatively small, a fuel jet injected from the nozzle 14 of the fuel injection valve 13 is almost atomized because the rate of vacuum pressure in the intake manifolds 2 is very high. Furthermore, a part of the fuel jet strikes against the extension 9 and is cut or sheared at the lower end knife edge 10 of the extension 9 with the mixture flowing in the passage. The fuel attached to and moving downwardly along the inner wall of the throttle bore 7 is also cut or sheared at the knife edge 10. Therefore, the atomization of fuel is promoted. In addition, during light-load or moderate-load driving operations, the speed of air flowing between the half body 12b of the throttle valve 12 and the inner wall of the throttle bore 7 is higher than the speed of air flowing in the opposite side of the throttle valve 12 and the nozzle 14 of the fuel injection valve 13 is arranged at the side in which air flows at a higher speed, so that the injected fuel is effectively atomized.

During a heavy-load driving operation in which the opening degree of the throttle valve 12 is relatively large, the throttle valve 12 may be arranged so that the fuel jet injected from the nozzle 14 of the fuel injection valve 13 attaches against the bottom side of the half body 12b of the throttle valve 12, thereby effectively promoting the atomization of fuel. A part of the fuel atomized as mentioned above attaches against the extension 9 before it flows into the collecting portion 3 of the intake manifold 2 and is cut or sheared at the lower end knife edge 10 of the extension 9 in the same manner as mentioned above, and thereby the atomization of fuel is further promoted. If the extension 9 and the knife edge 10 have special shapes as illustrated in FIGS. 4 and 5, it is possible to regulate or equalize the amount of fuel which is to be distributed into each cylinder of the engine.

The fuel atomized as mentioned above flows into a prescribed intake manifold 2 through the collecting portion 3. In that case, according to the embodiment illustrated in FIG. 2, as the direction in which the fuel is injected from the nozzle 14 of the fuel injection valve 13 corresponds to the direction in which the air fuel mixture flows in the intake manifolds 2, the atomized fuel flows smoothly from the collecting portion 3 into the prescribed intake manifold 2. Such an arrangement is advantageous for atomizing the fuel and for the timing response between the fuel injection time of the fuel injection valve 13 and the time at which the fuel is supplied to a prescribed cylinder of the engine. Therefore, according to the fuel injection type carburetor of the present invention, the atomization of fuel is promoted, the timing response for supplying fuel to each cylinder is improved and the amount of fuel to be supplied to each cylinder is uniformly controlled.

We claim:

1. A fuel injection type carburetor of multicylinder internal combustion engines comprising:

a throttle body having a throttle bore extending substantially vertically and being connected at the bottom portion thereof to a collecting portion of intake manifolds extending substantially horizontally, said throttle body having an extension formed integrally with said throttle body and extending downwardly into said collecting portion of the intake manifolds, said extension comprising a cylindrical thin wall formed integrally and coaxially with said throttle bore and having a sharp peripheral knife edge at the lower end thereof;

a throttle valve in said throttle bore;

a linear injection type fuel injection valve having a fuel injection nozzle in one side of said throttle bore downstream from said throttle valve and inclined toward the downstream side, so that a fuel jet injected from said fuel injection nozzle strikes against said extension of said throttle bore; and said cylindrical thin wall extending vertically downwardly at the side of said throttle bore substantially opposite said fuel injection valve to a substantially greater extent than at said one side of said throttle bore.

* * * * *